US008109217B2

(12) United States Patent
Krebs et al.

(10) Patent No.: US 8,109,217 B2
(45) Date of Patent: Feb. 7, 2012

(54) METHOD, DEVICE AND SYSTEM FOR ENHANCING COMBUSTION OF SOLID OBJECTS

(75) Inventors: Niels Krebs, Hellerup (DK); Jesper Cramer, Vanlose (DK); Niels Hald Pedersen, Hvidovre (DK)

(73) Assignee: Force Technology, Brondby (DK)

( * ) Notice: Subject to any disclaimer, the term of this patent is extended or adjusted under 35 U.S.C. 154(b) by 262 days.

(21) Appl. No.: 12/227,097

(22) PCT Filed: May 10, 2007

(86) PCT No.: PCT/DK2007/000221

§ 371 (c)(1),
(2), (4) Date: Jan. 21, 2009

(87) PCT Pub. No.: WO2007/128318

PCT Pub. Date: Nov. 15, 2007

(65) Prior Publication Data

US 2009/0235851 A1 Sep. 24, 2009

(30) Foreign Application Priority Data

May 10, 2006 (DK) ..... 2006 00660

(51) Int. Cl.
*F23B 99/00* (2006.01)

(52) U.S. Cl. ..... 110/218; 110/342

(58) Field of Classification Search ..... 110/347, 110/218, 266, 263, 249, 248; 181/142; 431/114; 422/128

See application file for complete search history.

(56) References Cited

U.S. PATENT DOCUMENTS

| | | | | |
|---|---|---|---|---|
| 3,005,282 | A | 10/1961 | Christiansen | |
| 4,635,571 | A * | 1/1987 | Olsson et al. | 110/297 |
| 5,687,610 | A | 11/1997 | Poulsen et al. | |
| 5,785,012 | A * | 7/1998 | Parsons et al. | 122/235.11 |
| 6,443,796 | B1 | 9/2002 | Shackelford | |
| 6,655,304 | B1 * | 12/2003 | Barlow | 110/347 |
| 2004/0105779 | A1 * | 6/2004 | Krebs | 422/26 |

FOREIGN PATENT DOCUMENTS

| | | | |
|---|---|---|---|
| EP | 0 590 432 | A2 | 4/1994 |
| WO | WO 90/09824 | | 9/1990 |
| WO | WO 00/41790 | | 7/2000 |
| WO | WO 01/97937 | A1 | 12/2001 |
| WO | WO 2006/042549 | A1 | 4/2006 |

* cited by examiner

*Primary Examiner* — Kenneth Rinehart
*Assistant Examiner* — David J Laux
(74) *Attorney, Agent, or Firm* — Day Pitney LLP

(57) ABSTRACT

A system, device and method for enhancing burning of a solid object in a combustion process is provided where one or more incineration devices (101) for burning a solid object (101), at least one sonic device (301) and wherein said at least one sonic device (301) is a transmitter of high intensity-ultrasound adapted to, during use, apply high intensity ultrasound to said solid object (101) thereby removing ash from said solid object (101) and increasing the speed of the burning of said solid object (101).

17 Claims, 7 Drawing Sheets

METHOD, DEVICE AND SYSTEM FOR ENHANCING COMBUSTION OF SOLID OBJECTS

FIELD OF THE INVENTION

The invention relates generally to combustion of one or more solid objects or particles. The invention more specifically relates to a method of, a device for and a system for enhancing burning of a solid object in a combustion process.

BACKGROUND OF THE INVENTION

Various aspects are of high priority when dealing with the combustion of solid objects or particles e.g. in an industrial power plant and/or a waste incineration plant and/or the like. Such aspects include fast and efficient energy production, waste management, and the desire to minimize pollution as much as possible without sacrificing efficiency. There is also an increase in the political and popular demand for green profiles within the industries of waste disposal and/or energy production.

One main inhibitor in obtaining an efficient combustion process is the presence of ash or the like, which at some point in the combustion process of a solid object or particle typically will be present on the outer surface.

Further, the energy and mass exchange at the surface of the solid(s) to be burnt is largely determined by the character of the flow of the combustion gas surrounding the solid(s) and more specifically by the character or presence of a so-called laminar sub-layer. Heat transport across the laminar sub-layer will typically be by conduction or radiation, due to the nature of the laminar flow while mass transport across the laminar sub-layer typically will be solely by diffusion.

Various methods and systems exists that aim at improving a combustion process.

Patent specification U.S. Pat. No. 4,592,292 relates to a method and apparatus for the combustion of large solid fuels. High particle velocity sound is generated by a resonator and is used to provide a reciprocating movement of combustion air and combustion gas through solid particles on a grate. The sound resonator is located in a chamber together with the grate and yields a standing sound wave with a maximum frequency of 60 Hz, preferably 30 Hz, optimal less than 20 Hz, across a bed of solid fuel.

Patent specification SE 7701764-8 discloses a method of combusting atomized solid, liquid or gaseous fuels. Only atomized fuels and not larger solid objects or particles are addressed. The atomization of the fuel into very small particles is done by disintegrator of various types (for solid fuels) or atomizers (for liquid fuels).

A problem addressed in this specification is that due to the fine atomization of the fuel it is hard to obtain oxidation of the atomized particles since the particles fast obtains the velocity of the combustion air/gas, i.e. no difference between the velocity of the particles and the surrounding air, due to the small mass of the atomized particles. During combustion, each atomized fuel particle will be surrounded by a number of combustion gases (like carbon oxide, etc.) which prevents oxygen to be in contact with the fuel particle, which prolongs the time of combustion and causes a physical extension of the combustion flame.

A proposed solution for overcoming these disadvantages is to supply sound energy to the combustion flame from a sound emitter, so that the velocity of the fuel particles becomes different from the velocity of the air particles due to the different masses of the fuel particles and the air particles.

It is mentioned that the sound energy can be supplied to the flame e.g. using a siren. It is further mentioned that various sound frequencies can be used. Non-audible sound (i.e. infrasound or ultra-sound) can be used due to sound-environmental considerations, i.e. to reduce noise. Further, it is mentioned that ultra-sound can be used for momentarily heating of the fuel or the fuel/air-mix. It is mentioned that sound energy can loosen ash from the atomized particles but it is also mentioned that this requires addition of an additive or some other means to make the ash porous or loose.

Patent specification JP 01095213 discloses an incinerator for cleaning a waste gas where the incinerator comprises a first and second incinerating chamber. The combustion gas, containing un-burnt parts, is introduced into the second incinerating chamber. Secondary air is provided through rotating air holes, rotating the air, into the second incinerating chamber.

Patent specification U.S. Pat. No. 5,996,808 relates to a method and a process for separation of carbon from fly ash of coal burning plants. An acoustic field is imposed in order to segregate the unburned coal from raw fly ash.

Patent specification U.S. Pat. No. 4,919,807 discloses an ultrasonic vibrator tray for separating particles from ash fragments. A transducer is mounted on the underside of the tray to induce vibrations in the slurry of particulate material.

Patent specification U.S. Pat. No. 5,680,824 discloses a process for burning solids with a sliding fire bar system provided with an airing system to optimize the combustion process.

Patent specification U.S. Pat. No. 5,419,877 discloses an acoustic barrier separator for industrial power plants. A sound wave is used for removal of small particles, such as fly ash, in gas.

Patent specification U.S. Pat. No. 5,785,012 discloses improvement of combustion in a combustion chamber, e.g. in a boiler, using acoustic energy where means for generating acoustic energy is located in the chamber in such a way that the energy is supplied to the chamber whereby particles and gasses is supplied with energy thereby improving the combustion process. The disclosed means for generating the acoustic energy are one or more acoustic horns located above in the combustion chamber. Alternatively, the means may be an electronic acoustic generator e.g. coupled to loudspeakers and amplifiers.

It is disclosed that the horn preferably operates at frequencies selected from 100-500 Hz, i.e. non-ultrasonic sound.

Patent specification EP 0144919 discloses a method of combustion of solids using a low-frequency sound generator.

Patent specification DE 1061021 discloses an apparatus for reducing the size of solids, primarily coal, using ultrasonic sound. The apparatus leads the solid coal through a conduit to the combustion chamber where the coal is reduced in size using reflection surfaces and an ultrasonic generator.

Patent specification DE 876439 discloses amplification of sound waves in a boiler where the amplified sound waves are provided to an acoustic horn via a funnel.

Patent specification EP 1162506 discloses an acoustic soot blower that removes dust at different temperatures depending on a gas pressure.

OBJECT AND SUMMARY OF THE INVENTION

It is an object of the present invention to provide a system (and corresponding method and device) for enhancing combustion of a solid object or particles, e.g. fuel, waste, etc., in a combustion process where the system solves (among other things) the above-mentioned shortcomings of prior art.

It is a further object to enabling efficient burning of one or more solid objects or particles reducing waste and increasing energy efficiency.

Another object is to enable an efficient removal or minimization of ash on a solid object or particles being part of a combustion process.

These objects (among others) are alleviated at least to an extent by a system for enhancing burning of a solid object in a combustion process, the system comprising one or more incineration devices for burning a solid object, at least one sonic device, wherein said at least one sonic device is an high intensity ultrasound device adapted to, during use, to apply high intensity ultrasound to said solid object thereby removing ash from said solid object and increasing turbulence around the solid object and thereby increasing the speed of the burning of said solid object, where a sound pressure level of said high intensity ultrasound is at least approximately 140 dB.

A sonic device is often also referred to as acoustic wave generator or the like. In the following the term sonic device is used. High intensity ultrasound is often also referred to as high intensity ultrasonic acoustic waves. High intensity ultrasound is used in the following.

High-intensity sound/ultrasound in gases leads to very high velocities and displacements of the gas molecules. As an example, sound pressure level of 160 dB corresponds to a particle velocity of 4.5 m/s and a displacement of 33 μm at 22.000 Hz. In other words, the application of high intensity sound or ultrasound increases the kinetic energy of the molecules significantly.

In this way, the large displacements and high kinetic energy of the gas molecules applied in the burning process due to the high intensity sound or ultrasound will make the air around the solid object oscillate with a high amount of kinetic energy. When the oscillating air meets the burning solids or particles, then any ash or the like that is present on the surface of the solid objects or particles to be incinerated (and thereby hinders the combustion process) will be 'shaken' off by the high energy sound thereby freeing new surfaces of unburned material and thus speeding up the inhomogeneous combustion process. This is enabled without the use of additives or some other means to make the ash porous or loose.

The present invention is very suitable for burning out ash and slag in a waste incineration plant or other types of combustion plants since the temperature of the ash, and of any present slag, will increase, which gives a better stabilization of heavy metals present in the slag, which again makes the slag recyclable. Slag is present e.g. if the process is a waste burning process.

Further, the application of ultrasound or high intensity sound will intensify the energy and mass exchange very efficiently at the surface of the objects to be incinerated due to a disruption of the laminar sub-layer.

In one embodiment, the solid object is located on a grate (e.g. a mowing grate) or another separator during combustion, at least one of said incineration devices is located under said grate or said other separator, and at least one of said at least one sonic device is located under said grate or other separator and applies high intensity ultrasound toward said solid object through said grate or said other separator.

In one embodiment, the combustion process takes place in a plant comprising a primary air distribution chamber distributing air to said at least one incineration device wherein at least one of said sonic devices is located in the primary air distribution chamber of said plant.

In one embodiment, at least one of the sonic devices are alternating switched on and off during the combustion process thereby reducing power consumption. Using the sonic devices intermittently or in bursts, i.e. only part of the time, reduces power (compared to using it throughout the entire process) while maintaining a high efficiency of the burning process since it takes some time for the ash to build up on the particles or solids. The 'on' period of time may be the same or different than the 'off' period of time.

In one embodiment, the combustion process takes place in a plant comprising an air injector for introducing secondary air to the combustion process wherein at least one of said sonic devices is located in the air injector. In almost all combustion plants secondary (thin and cold) air is injected (typically at high speed) in order to mix with the viscous hot air. The diffusion of the oxygen molecules and the other reactants in the process is normally restricting the rate of combustion. By introducing the secondary air using or accompanied by one or more sonic devices, the diffusion velocity of the secondary (cold) air molecules is increased thereby increasing the rate of combustion and decreasing the time needed to burn out CO, etc. The sonic devices preferably operate during substantially the entire process, which greatly enhances the efficiency of the combustion process. Alternatively, the sonic devices may operate in bursts, intermittently or in intervals, which reduces the overall power consumption.

In one embodiment, at least one of said at least one sonic devices comprises: an outer part and an inner part defining a passage, an opening, and a cavity provided in the inner part where said sonic device is adapted to receive a pressurized gas and pass the pressurized gas to said opening, from which the pressurized gas is discharged in a jet towards the cavity.

In one embodiment, at least one of said at least one sonic devices is at least partly driven by steam. I.e. steam is used as at least a part of the pressurized gas to drive the ultrasonic device.

In addition to the steam being used as propellant it will also greatly increase the reaction rate of the gasification processes taking place in the burning solids or particles because water molecules are an important reactant in the gasification processes, which will result in more uniform and higher combustion temperatures and higher quality of the slag.

In one embodiment, the sound pressure level of said high intensity ultrasound is selected from the interval between approximately 140 dB to approximately 160 dB, or above approximately 160 dB.

The present invention also relates to a method of enhancing burning of a solid object in a combustion process, the method comprising burning a solid object by one or more incineration devices, wherein method further comprises applying, during use, high intensity ultrasound from at least one sonic device to said solid object thereby removing ash from said solid object and increasing turbulence around the solid object and thereby increasing the speed of the burning of said solid object, where a sound pressure level of said high intensity ultrasound is at least approximately 140 dB.

The present invention further relates to a sonic device being a Hartmann type gas-jet acoustic wave generator comprising an outer part and an inner part defining a passage, an opening, and a cavity provided in the inner part, where said sonic device is adapted to receive a pressurized gas and pass the pressurized gas to said opening, from which the pressurized gas is discharged in a jet towards the cavity thereby generating high intensity ultrasound, and wherein said sonic device is adapted to, during use, to apply high intensity ultrasound to a solid object thereby removing ash from said solid object and increasing turbulence around the solid object and thereby increasing the speed of the burning of said solid object, where a sound pressure level of said high intensity ultrasound is at least approximately 140 dB.

The method and device and embodiments thereof correspond to the system and embodiments thereof and have the same advantages for the same reasons. Advantageous embodiments of the method and device according to the present invention are defined in the sub-claims and described in detail in the following.

BRIEF DESCRIPTION OF THE DRAWINGS

These and other aspects of the invention will be apparent from and elucidated with reference to the illustrative embodiments shown in the drawings, in which.

DESCRIPTION OF PREFERRED EMBODIMENTS

Figure 1:
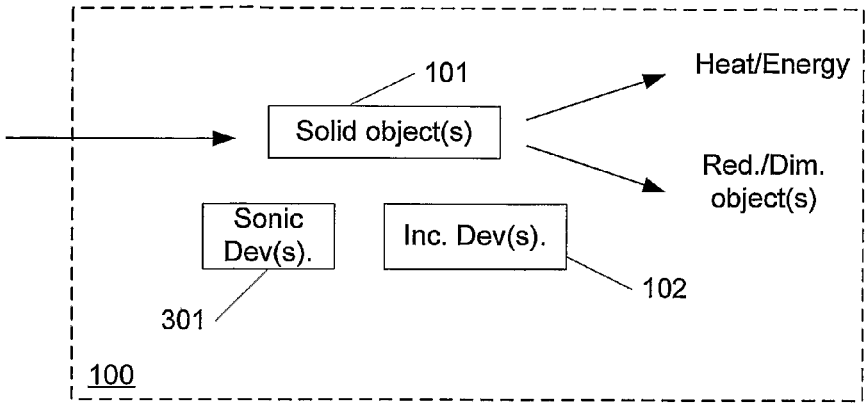
FIG. 1 schematically illustrates a generalized block diagram of one embodiment of a system/method of the present invention.

FIG. 1 schematically illustrates a generalized block diagram of one embodiment of a system/method of the present invention. Illustrated are one or more solid objects (101) to be burnt, e.g. coal, garbage, wood splinter, wood chip, other types of wood, straw, fuel, waste, dewatered sludge, etc. The solid object(s) (101) is passed to one or more incineration devices (102) and is burned while freeing heat and energy in the process. The solid object(s) (101) are reduced or diminished by the process, which is useful as the amount of waste is reduced. Furthermore, one or more sonic devices (301) for producing high intensity sound/ultrasound is present according to the present invention for enhancing the combustion process.

According to one embodiment of the present invention, ultrasound is applied to the solid object(s) (101), as described in greater detail in connection with FIGS. 3*a* and 4*a*, by a suitable sonic generator or device (301). In this way, the efficiency of burning of the solid object(s) is improved by applying ultrasound from one or more sonic devices e.g. driven by pressurized air, steam or another pressurized gas, i.e. gas-jet acoustic wave generators (transmitters).

When the oscillating air meets the burning solids or particles, then any ash or the like that is present on the surface of the solid objects or particles (and thereby hinders the combustion process) to be incinerated will be 'shaken' off by the high intensity sound thereby freeing new surfaces of unburned material and thus speeding up the inhomogeneous combustion process.

The present invention is very suitable for burning out ash and slag in a waste incineration plant or other types of combustion plants since the temperature of the ash, and of any present slag, will increase, which gives a better stabilization of heavy metals present in the slag, which again makes the slag recyclable. Slag is present e.g. if the process is a waste burning process.

Further, in addition to removing ash and/or other by-products from the surface of the solid(s), the generated high intensity ultrasound in a gas leads to very high velocities and displacements of the gas molecules, which in a very efficient way enhances the combustion process, as explained in the following.

The burning time of the solid(s), i.e. the time that the solid is exposed to the incineration flame from the incineration device(s), will depend on the amount (and type) of the solids being burnt at a single time. Typical burning times are e.g. a half to one hour for large amounts of solids. The burning time may be smaller for smaller amounts of solids.

A typical limitation of the combustion process is typically caused by the presence of a laminar sub-layer around a solid object surrounded by a gas. For nearly all practically occurring gas flows, the flow regime will normally be turbulent in the entirety of the flow, except for a layer covering all surfaces wherein the flow regime is laminar (see e.g. 313 in FIG. 2*a*). This layer is often called the laminar sub-layer. The thickness of this layer is a decreasing function of the Reynolds number of the flow, i.e. at high flow velocities, the thickness of the laminar sub layer will decrease.

Heat transport across the laminar sub layer will be by conduction or radiation, due to the nature of laminar flow. Further, mass transport across the laminar sub layer will be solely by diffusion. Decreasing the thickness of the laminar layer will typically enhance heat and mass transport significantly.

According to one embodiment of the present invention, high-intensive sound, which preferably have ultrasonic frequencies, (i.e. the high-intensity ultrasound) are applied to the surface of the solid object(s) in order to decrease the thickness of or remove the laminar sub-layer.

Figure 2A:
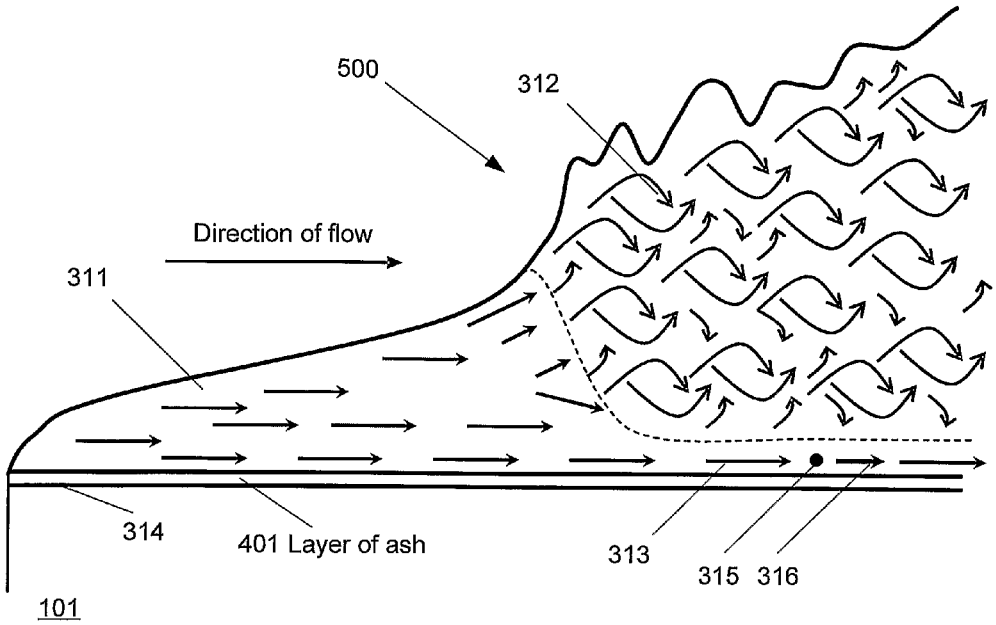
FIG. 2*a* schematically illustrates a (turbulent) flow over a surface of an object when no high intensity ultrasound is applied.
Figure 2B:
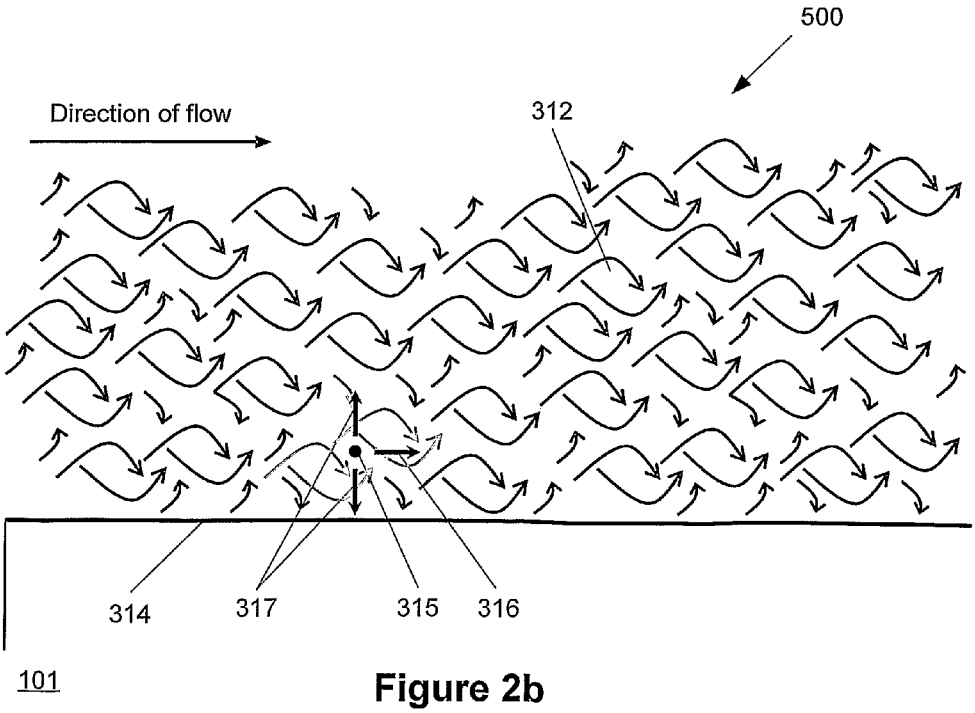
FIG. 2*b* schematically shows a flow over a surface of an object according to the present invention, where the effect of applying high intensity ultrasound to/in air/gas surrounding or contacting a surface of an object is illustrated.

The high-intensity ultrasound increases the interaction between the gas molecules and the surface (in addition to removing ash and the like) and thus increases the heat transfer by passive or active convection at the surface. The resulting reduction/minimization of the laminar sub-layer, as described in greater detail in connection with FIGS. 2*a* and 2*b*, provides increased heat transfer and increased mass transport efficiency due to reduction of laminar sub layer and increased diffusion speed thereby speeding up the combustion process.

In one embodiment, at least one of the sonic devices are alternating switched on and off during the combustion process thereby reducing power consumption. Using the sonic devices intermittently or in bursts, i.e. only part of the time, reduces power (compared to using it throughout the entire process) while a high efficiency of the burning process is maintained since it takes some time for the ash to build up on the particles or solids. The 'on' period of time may be the same or different than the 'off' period of time.

Very often a combustion or waste disposal plant will also comprise a secondary air inlet to inject (secondary) air (typically at high speed) in order to add more oxygen to the combustion process(es) and/or to lower the combustion temperature in the secondary combustion chamber. The high speed is typically applied in order to efficiently mix the secondary air (preferably being thin and cold) into the viscous hot air arising from the combustion process(es) taken place in the combustion chamber or room. The diffusion of the oxygen molecules and the other reactants is normally restricting the rate of combustion.

In another embodiment, as described in greater detail in connection with FIGS. 3*b* and 4*b*, high-intensity ultrasound is applied to in connection with the introduction of (secondary) air. One way is to introduce the secondary air through ultrasonic devices, e.g. in the form of gas-jet ultrasound generators, directly into the combustion room or chamber. The diffusion velocity of the cold air molecules is increased hereby, which will increase the rate of combustion and decrease the time needed to burn out CO, etc. from.

The sonic device(s) used in connection with the introduction of (secondary) air is/are preferably operated during substantially the entire process, which greatly enhances the efficiency of the combustion process. Alternatively, the sonic devices may operate in bursts, intermittently or in intervals, which reduces the overall power consumption.

Many types of ultrasound generators are suitable for these applications and one preferred well known ultrasound generator is explained in connection with FIGS. 5*a*-5*f*. See also FIGS. 3*a*-3*c* for various exemplary placements of sonic devices e.g. in an industrial power plant and/or waste incineration plant according to various embodiments. To activate the ultrasonic device(s), a pressurized gas like atmospheric air or steam with a pressure of about 2.5-4.5 atmospheres for some applications may be used.

FIG. 2*a* schematically illustrates a (turbulent) flow over a surface of a solid object according to prior art, i.e. when no ultrasound is applied to remove ash and create turbulence around the solid object. Shown is a surface (314) of an object to be burnt with a combustion gas (500) surrounding or contacting the surface (314). As mentioned, thermal energy can be transported through gas by conduction and also by the movement of the gas from one region to another. This process of heat transfer associated with gas movement is called convection. When the gas motion is caused only by buoyancy forces set up by temperature differences, the process is normally referred to as natural or free convection; but if the gas motion is caused by some other mechanism, such as forced air or the like, it is called forced convection. With a condition of forced convection there will typically be a laminar boundary layer (311) near to the surface (314). The thickness of this layer is a decreasing function of the Reynolds number of the flow, so that at high flow velocities, the thickness of the laminar boundary layer (311) will decrease. When the flow becomes turbulent the layer are divided into a turbulent boundary layer (312) and a laminar sub-layer (313). For nearly all practically occurring gas flows, the flow regime will be turbulent in the entirety of the streaming volume, except for the laminar sub-layer (313) covering the surface (314) wherein the flow regime is laminar. Considering a gas molecule or a particle (315) in the laminar sub-layer (313), the velocity (316) will be substantially parallel to the surface (314) and equal to the velocity of the laminar sub-layer (313). Heat transport across the laminar sub-layer will be by conduction or radiation, due to the nature of laminar flow. The presence of the laminar sub-layer (313) does not provide optimal or efficient heat transfer or increased mass transport. Any mass transport across the sub-layer has to be by diffusion so the diffusion process therefore will be the final limiting factor in an overall mass transport. This limits the availability of oxygen for the combustion process. Further, a layer or particles of ash or ash particles (401) will typically be present on the surface of the solid object thus hindering un-burnt parts of the solid to be efficiently exposed for burning.

FIG. 2*b* schematically shows a flow over a surface of a solid object to be burnt according to the present invention, where the effect of applying high intensity ultrasound to/in air/gas (500) surrounding or contacting a surface of a solid object is illustrated. More specifically, FIG. 2*b* illustrates the conditions when a surface (314) of a solid object to be burned is applied with high intensity ultrasound. Again consider a gas molecule/particle (315) in the laminar layer; the velocity (316) will be substantially parallel to the surface (314) and equal to the velocity of the laminar layer prior applying ultrasound. In the direction of the emitted sound field to the surface (314) in FIG. 3*b*, the oscillating velocity of the molecule (315) has been increased significantly as indicated by arrows (317).

As an example, a maximum velocity of v=4.5 m/sec and a displacement of +/−33 μm will be achieved where the ultrasound frequency f=22 kHz and the sound pressure level=160 dB. The corresponding (vertical) displacement in FIG. 2*b* is substantially 0 since the molecule follows the laminar air stream along the surface. In result, the ultrasound will establish a forced heat flow from the surface to surrounding gas/air (500) where the conduction is increasing by minimizing the laminar sub-layer.

In one embodiment, the sound pressure level is approximately 140 dB or larger. Preferably, the sound pressure level is selected from the range of approximately 140-160 dB. The sound pressure level may be above 160 dB.

Figure 3A:
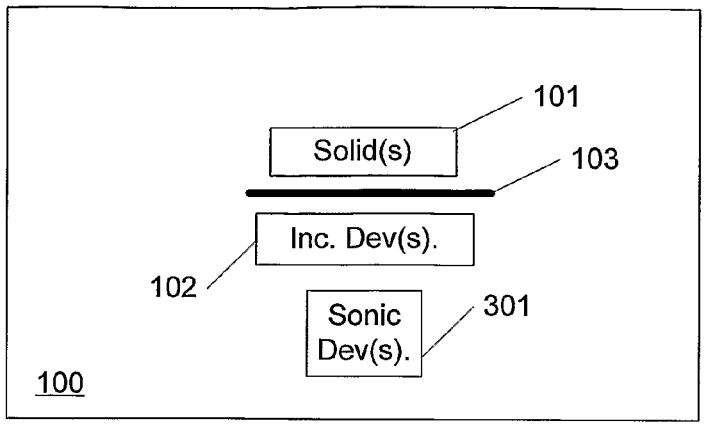
FIGS. 3*a*-3*c* schematically illustrates block diagrams of various embodiments of a system/method of the present invention.

FIG. 3*a* schematically illustrates block diagrams of an embodiment of a system/method of the present invention. Illustrated is any type of combustion system (100) comprising one or more solid object(s) (101) to be burnt, one or more incineration devices (102), and one or more sonic devices (301).

In this particular embodiment, the solid object(s) (101) is located on a grate or another separator (103) (forth only denoted grate) during combustion, where the incineration device(s) (102) are located under the grate so that the solid object(s) can be burnt while laying on the grate. Further, the sonic device(s) (301) is also located under the grate (103) and applies high intensity ultrasound toward the solid object(s) (101) through said grate (103). The incineration device(s) (102) and/or the sonic device(s) (301) may equally be located above or near the grate (103). What is important is that they are located so that they may apply their function, i.e. burning and application of ultrasound, respectively, to the solid object(s) (101) to be burned. The physical form of the incineration and sonic device(s) are not important and many forms may be envisioned e.g. a box or half box comprising outlets of incineration and sonic device(s). Additionally, the presence of a grate (103) or the like is not required.

In a preferred embodiment, the sonic device(s) are alternating switched on and off during the combustion process thereby reducing power consumption. Using the sonic devices intermittently or in bursts, i.e. only part of the time, reduces power (compared to using it throughout the entire process) while a high efficiency of the burning process is maintained since it takes some time for the ash to build up on the particles or solids. The 'on' period of time may be the same or different than the 'off' period of time.

The application of high intensity ultrasound enhances the combustion process as already described.

Figure 3B:
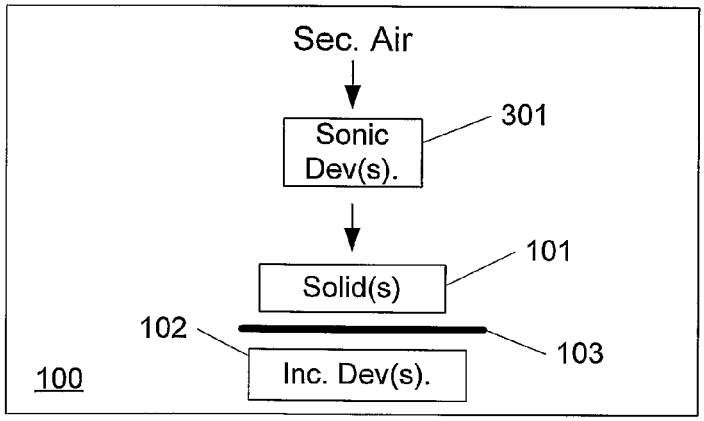

FIG. 3*b* schematically illustrates block diagrams of an embodiment of a system/method of the present invention. Illustrated is any type of combustion system (100) comprising one or more solid object(s) (101) to be burnt that is/are located on a grate (103) or the like, one or more incineration devices (102), and one or more sonic devices (301).

Further illustrated is secondary air being introduced to the combustion process e.g. via an air injector, air injection means, or the like wherein at least one of the sonic devices (301) is located in the air injector. The secondary (thin and cold) air is injected (typically at high speed) in order to mix with the viscous hot air. The diffusion of the oxygen molecules and the other reactants in the process is normally restricting the rate of combustion. By introducing the secondary air using or accompanied by one or more sonic devices, the diffusion velocity of the secondary (cold) air molecules is increased thereby increasing the rate of combustion and decreasing the time needed to burn out CO, etc. The sonic devices preferably operate during substantially the entire process, which greatly enhances the efficiency of the combustion process. Alternatively, the sonic devices may operate in bursts, intermittently or in intervals, which reduces the overall power consumption.

The sonic device(s) (301) may equally be located at another place than in the air injector. What is important is that they are located so that they may apply their function, i.e. application of ultrasound in the secondary air. Additionally, the presence of a grate (103) or the like is not required.

Figure 3C:
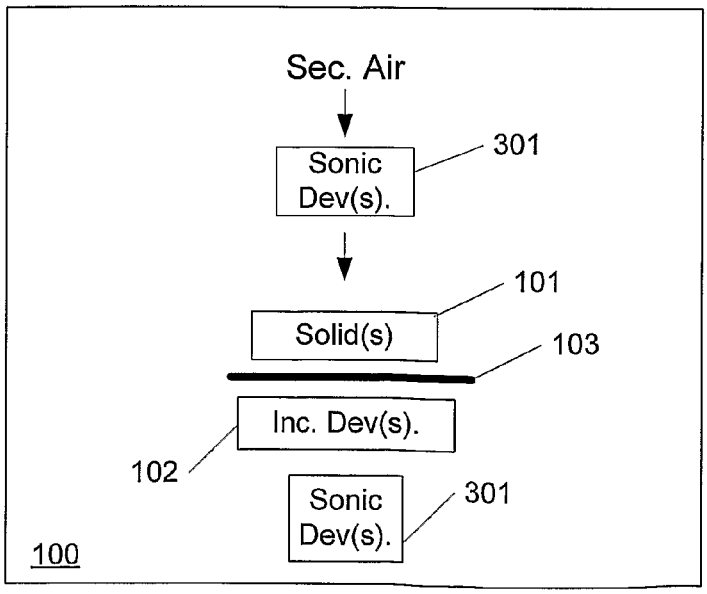

FIG. 3*c* schematically illustrates block diagrams of an embodiment of a system/method of the present invention. This embodiment combines the embodiments of FIGS. 3*a* and 3*b*.

Illustrated is any type of combustion system (100) where one or more solid object(s) (101) to be burnt being located on a grate (103) or the like, one or more incineration devices (102). Also shown is at least one sonic device (301) placed and functioning as described in connection with FIG. 3*a* and at least one sonic device (301) placed and functioning as described in connection with FIG. 3*b*.

Figure 4A:
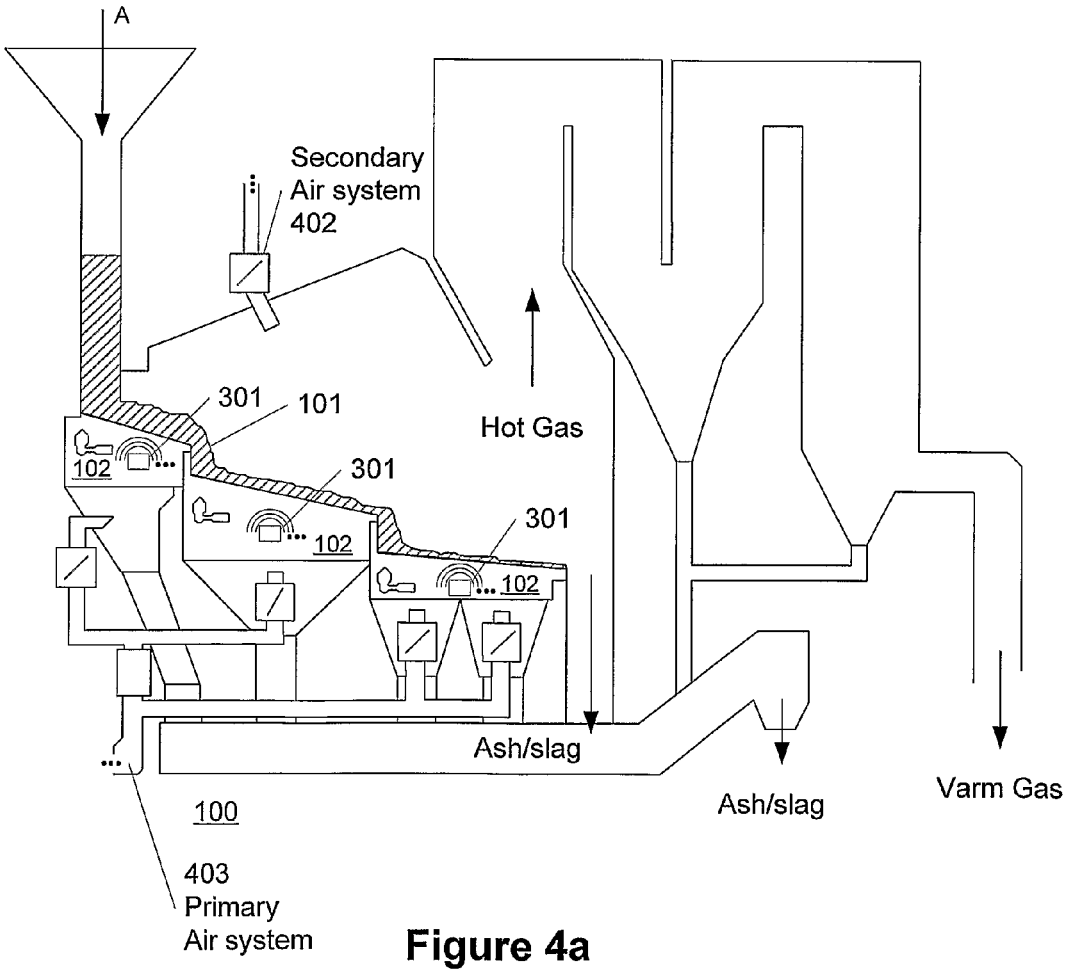
FIG. 4*a* schematically illustrates a waste incineration plant according to one embodiment of the present invention.

FIG. 4*a* schematically illustrates a waste incineration plant (100) according to one embodiment of the present invention. Shown is the embodiment of FIG. 3*a* being applied, as an example, in a combustion system, a waste incineration system, a recycle plant, a heat production system or the like.

Solid objects (101) to be burnt like coal, garbage, wood splinter, wood chip, other types of wood, straw, fuel, waste, dewatered sludge, etc. is introduced into the system as indicated by arrow (A) and the solid objects (101) passes by one or more incineration devices (102) and is burned while freeing heat and energy that may be used elsewhere. In this particular example, the solid objects (101) passes by 3 incineration devices (102) where the solid objects gradually will diminish as it is burned. The remaining part of the solid objects after the last incineration device (102) is collected as waste typically in the form of ash and/or slag. Waste may also be collected at each incineration device (102).

According to the present invention one or more sonic devices (301) is located in connection with each incineration device (102). Generally, one or more sonic devices (301) may be located at one or more incineration device(s) (102) e.g. with multiple sonic devices (301) a single incineration device (102).

Preferably, the at least one sonic device (301) is located in the proximity of a grate, a separator or the like near the incineration device (102) e.g. in the primary air system (403) that supplies air to the combustion process. The incineration device(s) (102) and/or the sonic device(s) (301) may equally be located above or near the grate. What is important is that they are located so that they may apply their function, i.e. burning and application of ultrasound, respectively, to the solid object(s) (101) to be burned. Additionally, the presence of a grate or the like is not required.

As mentioned the present invention is very suitable for burning out ash and slag in a waste incineration plant or other types of combustion plants since the temperature of the ash, and of any present slag, will increase, which gives a better stabilization of heavy metals present in the slag, which again makes the slag recyclable.

Further, the application of high intensity ultrasound will intensify the energy and mass exchange very efficiently at the surface of the objects to be incinerated due to a disruption of the laminar sub-layer, as explained earlier.

In one embodiment, at least one of the acoustic wave generators are alternating switched on and off during the combustion process thereby reducing power consumption. Using the acoustic wave generators intermittently or in bursts, i.e. only part of the time, reduces power (compared to using it throughout the entire process) while maintaining a high efficiency of the burning process since it takes some time for the ash to build up on the particles or solids. The 'on' period of time may be the same or different than the 'off' period of time.

The combustion system will also typically comprise one or more secondary air systems (402) for introducing and mixing (cold) air into the combustion chamber.

Figure 4B:
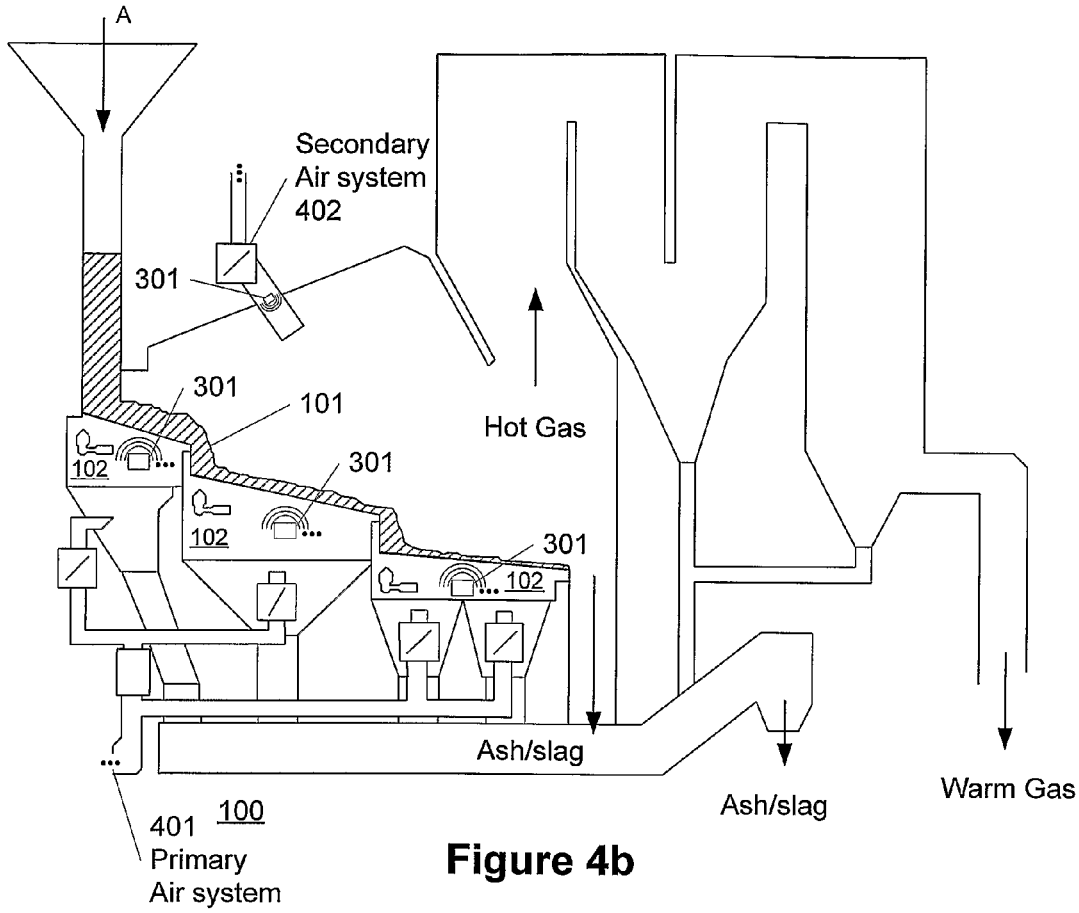
FIG. 4*b* schematically illustrates a waste incineration plant according to another embodiment of the present invention.

FIG. 4*b* schematically illustrates a waste incineration plant (100) according to another embodiment of the present invention. Shown is the embodiment of FIG. 3*b* being applied, as an example, in a combustion system, a waste incineration system, a recycle plant, a heat production system or the like.

This embodiment corresponds to the embodiment of FIG. 4*a* in that one or more sonic devices are located in a secondary air system (402) instead of at an incineration device (102).

By introducing the secondary air using or accompanied by one or more sonic devices, the diffusion velocity of the secondary (cold) air molecules is increased thereby increasing the rate of combustion and decreasing the time needed to burn out CO, etc. The sonic devices preferably operate during substantially the entire process, which greatly enhances the efficiency of the combustion process. Alternatively, the sonic devices may operate in bursts, intermittently or in intervals, which reduces the overall power consumption.

The sonic device(s) (301) may equally be located at another place than in the secondary air system (402). What is important is that they are located so that they may apply their function, i.e. application of ultrasound in the secondary air.

The embodiments of FIG. 4*a* and 4*b* may be combined, as explained in connection with FIG. 3*c*, for an even larger overall efficiency.

Figure 5E:
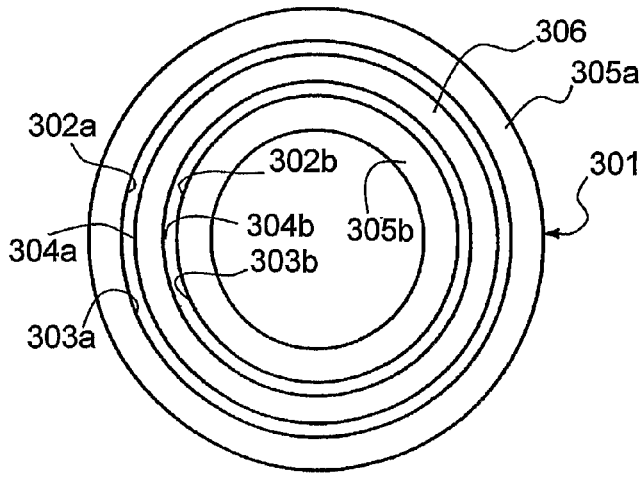
FIG. 5*e* shows an ultrasound device of the same type as in FIG. 5*d* but shaped as a closed curve.
Figure 5A:
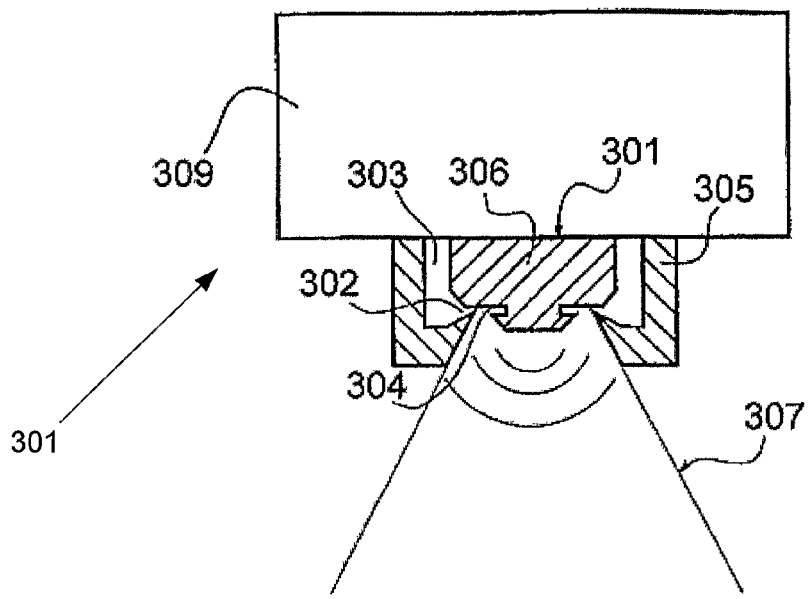
FIG. 5*a* schematically illustrates a preferred embodiment of a device for generating high intensity ultrasound.

FIG. 5*a* schematically illustrates a preferred embodiment of a device (301) for generating high intensity ultrasound. Pressurized gas is passed from a tube or chamber (309) through a passage (303) defined by the outer part (305) and the inner part (306) to an opening (302), from which the gas is discharged in a jet towards a cavity (304) provided in the inner part (306). If the gas pressure is sufficiently high then oscillations are generated in the gas being fed to the cavity (304) at a frequency defined by the dimensions of the cavity (304) and the opening. (302). An ultrasound generator bf the type shown in FIG. 5*a* is able to generate ultrasonic acoustic waves with a sound pressure level of up to 160 dB at a gas pressure of about 2.5-4.5 atmospheres. The ultrasound device may e.g. be made from brass, aluminum or stainless steel or in any other sufficiently hard material to withstand the acoustic pressure and temperature to which the device is subjected during use.

Please note, that the pressurized gas can be different from the gas that contacts or surrounds the object.

Figure 5B:
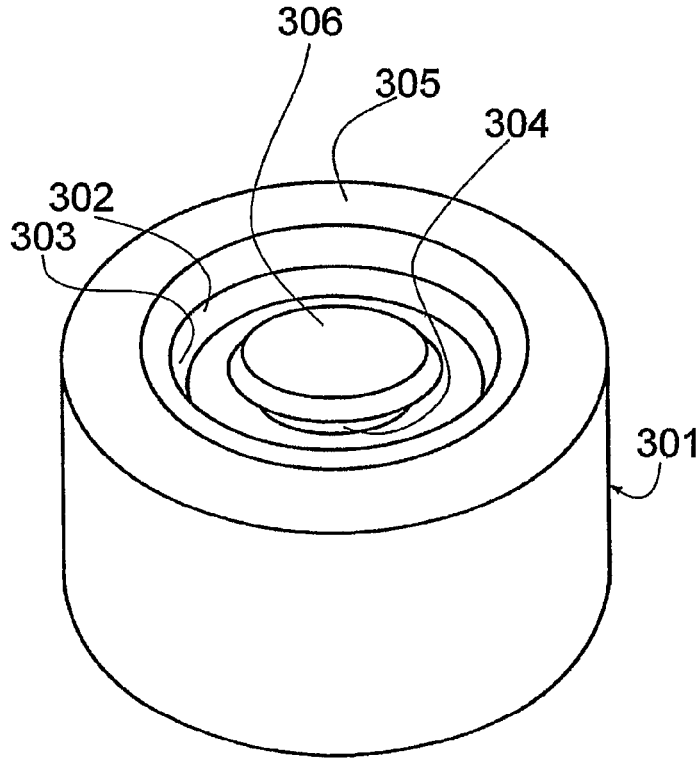
FIG. 5*b* shows an embodiment of an ultrasound device in form of a disk-jet Hartmann generator.

FIG. 5*b* shows an embodiment of an ultrasound device in form of a disk-jet Hartmann generator. Shown is a preferred embodiment of an ultrasound device (301), i.e. a so-called disk-jet Hartmann generator. The device (301) comprises an annular outer part (305) and a cylindrical inner part (306), in which an annular cavity (304) is recessed. Through an annular gas passage (303) gases may be diffused to the annular opening (302) from which it may be conveyed to the cavity (304). The outer part (305) may be adjustable in relation to the inner part (306), e.g. by providing a thread or another adjusting device (not shown) in the bottom of the outer part (305), which further may comprise fastening means (not shown) for locking the outer part (305) in relation to the inner part (306), when the desired interval there between has been obtained. Such an ultrasound device may generate a frequency of about 22 kHz at a gas pressure of 4 atmospheres. The molecules of the gas are thus able to migrate up to 33 μm about 22,000 times per second at a maximum velocity of 4.5 m/s. These values are merely included to give an idea of the size and proportions of the ultrasound device and should by no means limit the shown embodiment.

Figure 5C:
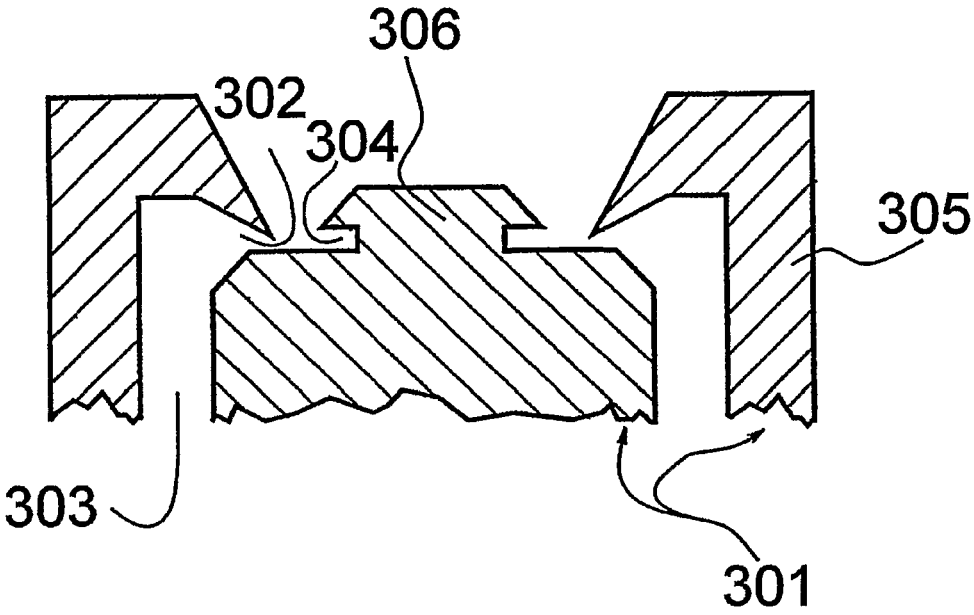
FIG. 5*c* is a sectional view along the diameter of the ultrasound device (301) in FIG. 5*b* illustrating the shape of the opening (302), the gas passage (303) and the cavity (304) more clearly.

FIG. 5*c* is a sectional view along the diameter of the ultrasound device (301) in FIG. 5*b* illustrating the shape of the opening (302), the gas passage (303) and the cavity (304) more clearly. It is further apparent that the opening (302) is annular. The gas passage (303) and the opening (302) are defined by the substantially annular outer part (305) and the cylindrical inner part (306) arranged therein. The gas jet discharged from the opening (302) hits the substantially circumferential cavity (304) formed in the inner part (306), and then exits the ultrasound device (301). As previously mentioned the outer part (305) defines the exterior of the gas passage (303) and is further bevelled at an angle of about 30° along the outer surface of its inner circumference forming the opening of the ultrasound device, wherefrom the gas jet may expand when diffused. Jointly with a corresponding bevelling of about 60° on the inner surface of the inner circumference, the above bevelling forms an acute-angled circumferential edge defining the opening (302) externally. The inner part (306) has a bevelling of about 45° in its outer circumference facing the opening and internally defining the opening (302). The outer part (305) may be adjusted in relation to the inner part (306), whereby the pressure of the gas jet hitting the cavity (304) may be adjusted. The top of the inner part (306), in which the cavity (304) is recessed, is also bevelled at an angle of about 45° to allow the oscillating gas jet to expand at the opening of the ultrasound device.

Figure 5D:
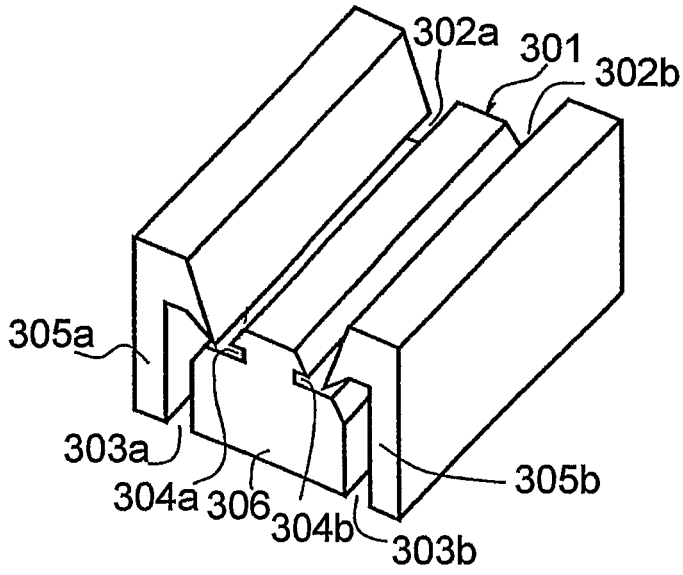
FIG. 5*d* illustrates an alternative embodiment of another type of the Hartmann acoustic wave generators, which is, shaped as an elongated body.

FIG. 5*d* illustrates an alternative embodiment of the Hartmann type gas-jet ultrasound generator, which is shaped as an elongated body. Shown is an ultrasound device comprising an elongated substantially rail-shaped body (301), where the body is functionally equivalent with the embodiments shown in FIGS. 5*a* and 5*b*, respectively. In this embodiment the outer part comprises two separate rail-shaped portions (305*a*) and (305*b*), which jointly with the rail-shaped inner part (306) form an ultrasound device (301). Two gas passages (303*a*) and (303*b*) are provided between the two portions (305*a*) and (305*b*) of the outer part (305) and the inner part (306). Each of said gas passages has an opening (302*a*), (302*b*), respectively, conveying emitted gas from the gas passages (303*a*) and (303*b*) to two cavities (304*a*), (304*b*) provided in the inner part (306). One advantage of this embodiment is that a rail-shaped body is able to coat a far larger surface area than a circular body. Another advantage of this embodiment is that the ultrasound device may be made in an extruding process, whereby the cost of materials is reduced.

FIG. 5*e* shows an ultrasound device of the same type as in FIG. 5*d* but shaped as a closed curve. The embodiment of the gas device shown in is FIG. 5*d* does not have to be rectilinear. FIG. 5*e* shows a rail-shaped body (301) shaped as three circular, separate rings. The outer ring defines an outermost part (305*a*), the middle ring defines the inner part (306) and the inner ring defines an innermost outer part (305*b*). The three parts of the Hartmann type ultrasound device jointly form a cross section as shown in the embodiment in FIG. 5*d*, wherein two cavities (304*a*) and (304*b*) are provided in the inner part, and wherein the space between the outermost outer part (305*a*) and the inner part (306) defines an outer gas passage (303*a*) and an outer opening (302*a*), respectively, and the space between the inner part (306) and the innermost outer part (305*b*) defines an inner gas passage (304*b*) and an inner opening (302*b*), respectively. This embodiment of an ultrasound device is able to coat a very large area at a time and thus treat the surface of large objects.

Figure 5F:
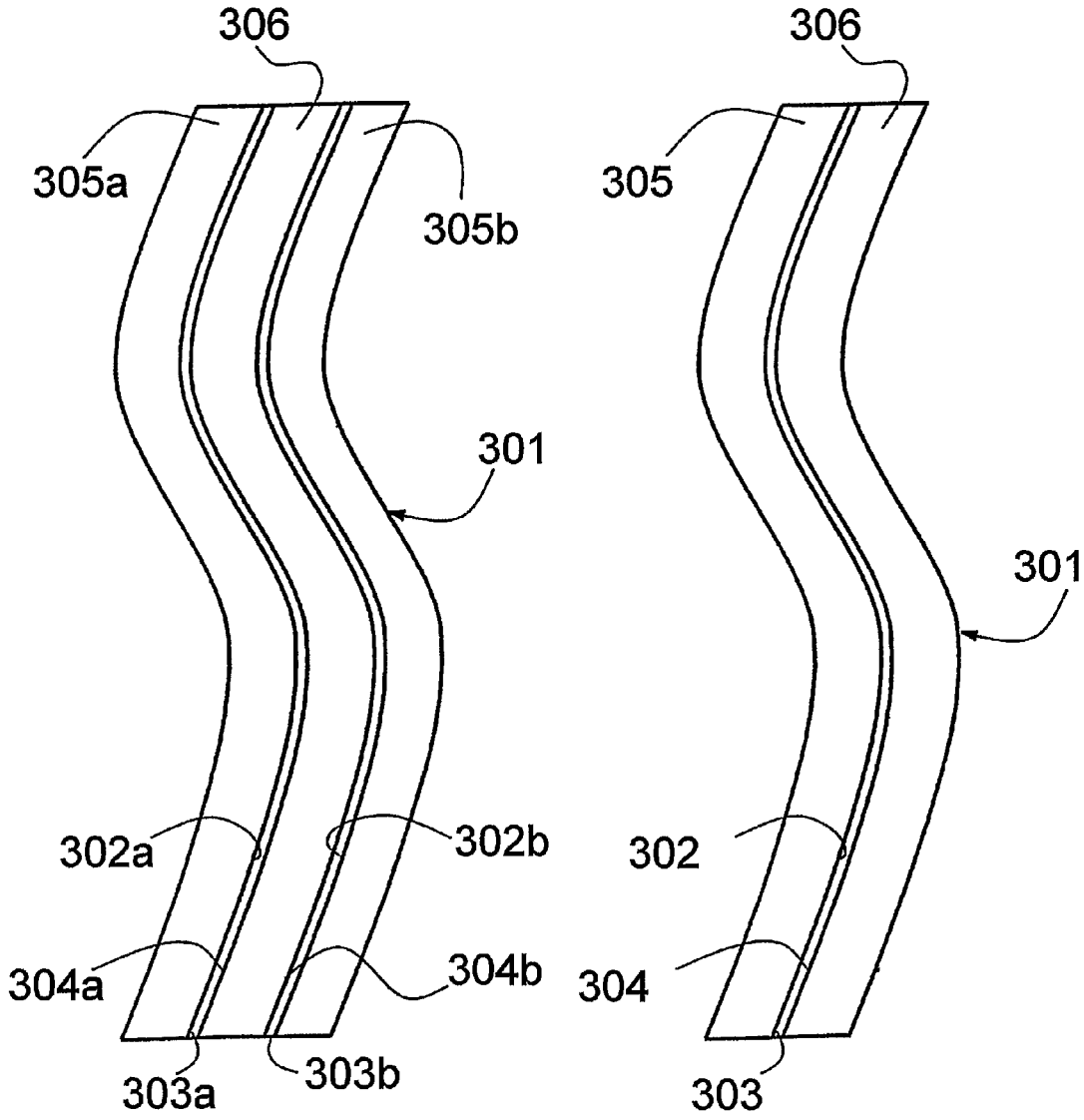
FIG. 5*f* shows an ultrasound device of the same type as in FIG. 5*d* but shaped as an open curve.

FIG. 5*f* shows an ultrasound device of the same type as in FIG. 5*d* but shaped as an open curve. As shown it is also possible to form an ultrasound device of the Hartmann type as an open curve. In this embodiment, the functional parts correspond to those shown in FIG. 5*d* and other details appear from this portion of the description for which reason reference is made thereto. Likewise, it is also possible to form an ultrasound device with only one opening as described in FIG. 5*b*. An ultrasound device shaped as an open curve is applicable where the surfaces of the treated object have unusually shapes. A system is envisaged in which a plurality of ultrasound devices shaped as different open curves are arranged in an apparatus according to the invention.

In the claims, any reference signs placed between parentheses shall not be constructed as limiting the claim. The word "comprising" does not exclude the presence of elements or steps other than those listed in a claim. The word "a" or "an" preceding an element does not exclude the presence of a plurality of such elements.

The invention claimed is:

1. A system for enhancing burning of a solid object in a combustion process, the system (100) comprising:

one or more incineration devices (102) for burning a solid object (101), at least one sonic device (301), characterized in that said at least one sonic device (301) is an high intensity ultrasound device adapted to, during use, to apply high intensity ultrasound to said solid object (101) thereby removing ash from said solid object (101) and increasing turbulence around the solid object (101) and thereby increasing the speed of the burning of said solid object (101), where a sound pressure level of said high intensity ultrasound is at least approximately 140 dB.

2. A system according to claim 1, wherein said solid object (101) is located on a grate or an other separator (103), during combustion, at least one of said incineration devices (102) is located under said grate or said other separator (103), and at least one of said at least one sonic device (301) is located under said grate or other separator (103) and applies high intensity ultrasound toward said solid object (101) through said grate or said other separator (103).

3. A system according to claim 1, wherein said combustion process takes place in a plant comprising a primary air distribution chamber distributing air to said at least one incineration devices (102) and wherein at least one of said sonic devices (301) is located in the primary air distribution chamber of said plant.

4. A system according to claim 1, wherein at least one of said sonic devices (301) are alternating switched on and off during the combustion process thereby reducing power consumption.

5. A system according to claim 1, wherein said combustion process takes place in a plant comprising air injection means for introducing secondary air to the combustion process and wherein at least one of said sonic devices (301) is located in the air injection means.

6. A system according to claim 1, wherein at least one of said at least one sonic devices (301) is a Hartmann type gas-jet acoustic wave generator that comprises:

an outer part (305) and an inner part (306) defining a passage (303), an opening (302), and a cavity (304) provided in the inner part (306)

where said sonic device (301) is adapted to receive a pressurized gas and pass the pressurized gas to said opening (302), from which the pressurized gas is discharged in a jet towards the cavity (304).

7. A system according to claim 1, at least one of said at least one sonic device (301) is at least partly driven by steam.

8. A system according to claim 1, wherein the sound pressure level of said high intensity ultrasound is selected from the interval between approximately 140 dB to approximately 160 dB, or above approximately 160 dB.

9. A method of enhancing burning of a solid object in a combustion process, the method comprising burning a solid object (101) by one or more incineration devices (102), characterized in that said method further comprises applying, during use, high intensity ultrasound from at least one sonic device (301) to said solid object (101) thereby removing ash from said solid object (101) and increasing turbulence around the solid object (101) and thereby increasing the speed of the burning of said solid object (101), where a sound pressure level of said high intensity ultrasound is at least approximately 140 dB.

10. A method according to claim 9, wherein said method further comprises applying high intensity ultrasound toward said solid object (101) through a grate or other separator (103), where said solid object (101) is located on said grate or other separator (103) during combustion and where at least one of said incineration devices (102) and at least one of said at least one sonic device (301) are located under said grate or said other separator (103).

11. A method according to claim 9, wherein said combustion process takes place in a plant comprising a primary air distribution chamber distributing air to said at least one incineration devices (102) and wherein at least one of said sonic devices (301) is located in the primary air distribution chamber of said plant.

12. A method according to claim 9, wherein said method comprises alternating switching at least one of said sonic devices (301) on and off during the combustion process thereby reducing power consumption.

13. A method according to claim 9, wherein said combustion process takes place in a plant comprising air injection means for introducing secondary air to the combustion process and wherein at least one of said sonic devices (301) is located in the air injection means.

14. A method according to claim 9, wherein at least one of said at least one sonic devices (301) is a Hartmann type gas-jet acoustic wave generator that comprises:

an outer part (305) and an inner part (306) defining a passage (303), an opening (302), and a cavity (304) provided in the inner part (306)

where said sonic device (301) receives a pressurized gas and passes the pressurized gas to said opening (302), from which the pressurized gas is discharged in a jet towards the cavity (304).

15. A method according to claim 9, wherein said method comprises driving at least one of said at least one sonic device (301) at least partly by steam.

16. A method according to claim 9, wherein the sound pressure level of said high intensity ultrasound is selected from the interval between approximately 140 dB to approximately 160 dB, or above approximately 160 dB.

17. A sonic device (301) being a Hartmann type gas jet acoustic wave generator comprising an outer part (305) and an inner part (306) defining a passage (303), an opening (302), and a cavity (304) provided in the inner part (306), where said sonic device (301) is adapted to receive a pressurized gas and pass the pressurized gas to said opening (302), from which the pressurized gas is discharged in a jet towards the cavity (304) thereby generating high intensity ultrasound, characterized in that said sonic device (301) is adapted to, during use, to apply high intensity ultrasound to a solid object (101) thereby removing ash from said solid object (101) and increasing turbulence around the solid object (101) and thereby increasing the speed of the burning of said solid object (101), where a sound pressure level of said high intensity ultrasound is at least approximately 140 dB.

* * * * *